US011170686B2

(12) United States Patent
Kang et al.

(10) Patent No.: US 11,170,686 B2
(45) Date of Patent: Nov. 9, 2021

(54) DISPLAY DEVICE PERFORMING AN OVER-CURRENT PROTECTION OPERATION

(71) Applicant: Samsung Display Co., Ltd., Yongin-Si (KR)

(72) Inventors: Keun Oh Kang, Uijeongbu-si (KR); Dae-Sik Lee, Hwaseong-si (KR); Ji Youn Seo, Asan-si (KR); Jong Jae Lee, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/023,806

(22) Filed: Sep. 17, 2020

(65) Prior Publication Data

US 2021/0183289 A1 Jun. 17, 2021

(30) Foreign Application Priority Data

Dec. 16, 2019 (KR) ..... 10-2019-0167446

(51) Int. Cl.
*G09G 3/20* (2006.01)

(52) U.S. Cl.
CPC ..... *G09G 3/20* (2013.01); *G09G 2310/0267* (2013.01); *G09G 2310/0281* (2013.01); *G09G 2310/08* (2013.01); *G09G 2330/025* (2013.01); *G09G 2330/04* (2013.01); *G09G 2330/08* (2013.01)

(58) Field of Classification Search
None
See application file for complete search history.

(56) References Cited

U.S. PATENT DOCUMENTS

2015/0194800 A1* 7/2015 Kim ..... G09G 3/3677 361/95
2020/0020265 A1* 1/2020 Lee ..... G09G 5/008

FOREIGN PATENT DOCUMENTS

KR 1020150081867 A 7/2015
KR 101697527 B1 1/2017
KR 1020190045816 A 5/2019

* cited by examiner

*Primary Examiner* — Ifedayo B Iluyomade
(74) *Attorney, Agent, or Firm* — Cantor Colburn LLP

(57) ABSTRACT

A display device includes a display panel including a plurality of pixels, a controller which generates a gate reference signal, a gate control circuit which outputs a gate driving signal based on the gate reference signal, and a gate driving circuit which provides gate signals to the plurality of pixels based on the gate driving signal. The gate control circuit includes a protection enable circuit which detects a first period of the gate reference signal, determines whether the period of the gate reference signal is changed, and generates a protection enable signal when the first period of the gate reference signal is not changed, and an over-current protection circuit which generates an over-current occurrence signal by detecting an over-current of the gate driving signal, and stops outputting the gate driving signal based on the over-current occurrence signal and the protection enable signal.

20 Claims, 9 Drawing Sheets

DISPLAY DEVICE PERFORMING AN OVER-CURRENT PROTECTION OPERATION

This application claims priority to Korean Patent Application No. 10-2019-0167446, filed on Dec. 16, 2019, and all the benefits accruing therefrom under 35 U.S.C. § 119, the content of which in its entirety is herein incorporated by reference.

BACKGROUND

1. Field

Exemplary embodiments relate to a display device, and more particularly to a display device performing an over-current protection operation.

2. Description of the Related Art

A display device may include a display panel including a plurality of pixels, and a driver for driving the display panel to display an image. In order to drive the display panel, the driver may provide various driving voltages to the display panel through driving voltage lines. In a case where a short-circuit defect occurs between the driving voltage lines of the display panel, an over-current may flow through the driving voltage lines. By the over-current of the driving voltage lines, the display panel not only may not normally operate, but also may be damaged.

SUMMARY

To prevent the damage of the display panel, the display panel may include an over-current protection circuit that detects the over-current, and stops driving the display panel when the over-current is detected. In general, the over-current protection circuit may perform an over-current detection operation in response to a reference signal generated by a controller. However, in a case where the reference signal is abnormal, the over-current protection circuit may perform an abnormal operation, and thus the display panel may not normally operate.

Some exemplary embodiments provide a display device capable of preventing an abnormal operation of an over-current protection circuit even if a gate reference signal is abnormal.

According to exemplary embodiments, a display device includes a display panel including a plurality of pixels, a controller which generates a gate reference signal, a gate control circuit which outputs a gate driving signal based on the gate reference signal, and a gate driving circuit which provides gate signals to the plurality of pixels based on the gate driving signal. The gate control circuit includes a protection enable circuit which detects a first period of the gate reference signal, determines whether the first period of the gate reference signal is changed, and generates a protection enable signal when the first period of the gate reference signal is not changed, and an over-current protection circuit which generates an over-current occurrence signal by detecting an over-current of the gate driving signal, and stops outputting the gate driving signal based on the over-current occurrence signal and the protection enable signal.

In exemplary embodiments, the protection enable circuit may determine that the first period of the gate reference signal is not changed when consecutive periods of the gate reference signal detected for a reference number of periods including the first period have a time difference from each other less than a reference time difference.

In exemplary embodiments, the protection enable circuit may include an internal clock generator which generates an internal clock signal, a clock counter which counts the number of clocks of the internal clock signal during each period of the gate reference signal, and outputs a counting signal representing the counted number of the clocks of the internal clock signal, a reference storage which stores the reference number of periods, and a reference clock number difference corresponding to the reference time difference, and a protection-enable-signal generator which generates the protection enable signal when the counting signals of which a number corresponds to the reference number of periods have a clock number difference from each other less than the reference clock number difference.

In exemplary embodiments, the reference number of periods may be settable.

In exemplary embodiments, the reference time difference may be settable.

In exemplary embodiments, the protection enable circuit may detect, as the first period of the gate reference signal, a time interval between adjacent rising edges of the gate reference signal.

In exemplary embodiments, the protection enable circuit may detect, as the first period of the gate reference signal, a time interval between adjacent falling edges of the gate reference signal.

In exemplary embodiments, the gate reference signal may include a reference clock signal. The gate control circuit may generate a gate clock signal as the gate driving signal based on the reference clock signal, and may output the gate clock signal to the gate driving circuit.

In exemplary embodiments, the protection enable circuit may detect consecutive periods of the reference clock signal, may determine whether the periods of the reference clock signal detected for a reference number of periods have a time difference from each other less than a reference time difference, and may generate the protection enable signal when the periods of the reference clock signal have the time difference from each other less than the reference time difference.

In exemplary embodiments, the gate reference signal may include a reference start signal. The gate control circuit may generate a gate start signal as the gate driving signal based on the reference start signal, and may output the gate start signal to the gate driving circuit.

In exemplary embodiments, the protection enable circuit may detect consecutive periods of the reference start signal, may determine whether the periods of the reference start signals detected for a reference number of periods have a time difference from each other less than a reference time difference, and may generate the protection enable signal when the periods of the reference start signal have the time difference from each other less than the reference time difference.

In exemplary embodiments, the over-current protection circuit may include an over-current detect circuit which detects the over-current of the gate driving signal by comparing a current of the gate driving signal with a reference current, and generates the over-current occurrence signal when the over-current is detected, and a driving-stop circuit which generates an output-stop signal representing that outputting the gate driving signal is to be stopped based on the over-current occurrence signal and the protection enable signal.

In exemplary embodiments, the display device may further include a power circuit which generates a gate-on voltage and a gate-off voltage. The gate control circuit may further include a first switch which outputs the gate-on voltage as the gate driving signal, a second switch which outputs the gate-off voltage as the gate driving signal, and a switch control circuit which controls the first and second switches based on the gate reference signal.

In exemplary embodiments, the over-current protection circuit may generate an output-stop signal based on the over-current occurrence signal and the protection enable signal, and the switch control circuit may turn off the first and second switches based on the output-stop signal.

In exemplary embodiments, the power circuit and the gate control circuit may be disposed in a power management integrated circuit.

In exemplary embodiments, the gate driving circuit may be disposed in a peripheral region of the display panel.

According to exemplary embodiments, a display device includes a display panel including a plurality of pixels, a controller which generates a reference start signal and a reference clock signal, a gate control circuit which outputs a gate start signal and a gate clock signal based on the reference start signal and the reference clock signal, and a gate driving circuit which provides gate signals to the plurality of pixels based on the gate start signal and the gate clock signal. The gate control circuit includes a protection enable circuit which detects a first period of the reference clock signal, determines whether the first period of the reference clock signal is changed, and generates a protection enable signal when the first period of the reference clock signal is not changed, and an over-current protection circuit which generates an over-current occurrence signal by detecting an over-current of the gate start signal or the gate clock signal, and stops outputting the gate start signal and the gate clock signal based on the over-current occurrence signal and the protection enable signal.

In exemplary embodiments, the protection enable circuit may determine that the first period of the reference clock signal is not changed when consecutive periods of the reference clock signal detected for a reference number of periods including the first period have a time difference from each other less than a reference time difference.

According to exemplary embodiments, there a display device includes a display panel including a plurality of pixels, a controller which generates a reference start signal and a reference clock signal, a gate control circuit which outputs a gate start signal and a gate clock signal based on the reference start signal and the reference clock signal, and a gate driving circuit which provides gate signals to the plurality of pixels based on the gate start signal and the gate clock signal. The gate control circuit includes a protection enable circuit which detects a first period of the reference start signal, determines whether the first period of the reference start signal is changed, and generates a protection enable signal when the first period of the reference start signal is not changed, and an over-current protection circuit which generates an over-current occurrence signal by detecting an over-current of the gate start signal or the gate clock signal, and stops outputting the gate start signal and the gate clock signal based on the over-current occurrence signal and the protection enable signal.

In exemplary embodiments, the protection enable circuit may determine that the first period of the reference start signal is not changed when consecutive periods of the reference start signal detected for a reference number of periods including the first period have a time difference from each other less than a reference time difference.

As described above, in a display device according to exemplary embodiments, a protection enable circuit may detect a period of a gate reference signal, and an over-current protection circuit may perform an over-current protection operation when the period of the gate reference signal is not changed, and an over-current of a gate driving signal is detected. Accordingly, an undesired over-current protection operation may be prevented or may not be performed even if the gate reference signal is abnormal.

BRIEF DESCRIPTION OF THE DRAWINGS

Illustrative, non-limiting exemplary embodiments will be more clearly understood from the following detailed description in conjunction with the accompanying drawings.

DETAILED DESCRIPTION

Hereinafter, embodiments of the present inventive concept will be explained in detail with reference to the accompanying drawings. It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein. The terminology used herein is for the purpose of describing particular embodiments only and is not intended to be limiting. As used herein, the singular forms "a," "an," and "the" are intended to include the plural forms, including "at least one," unless the content clearly indicates otherwise.

"At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Figure 1:
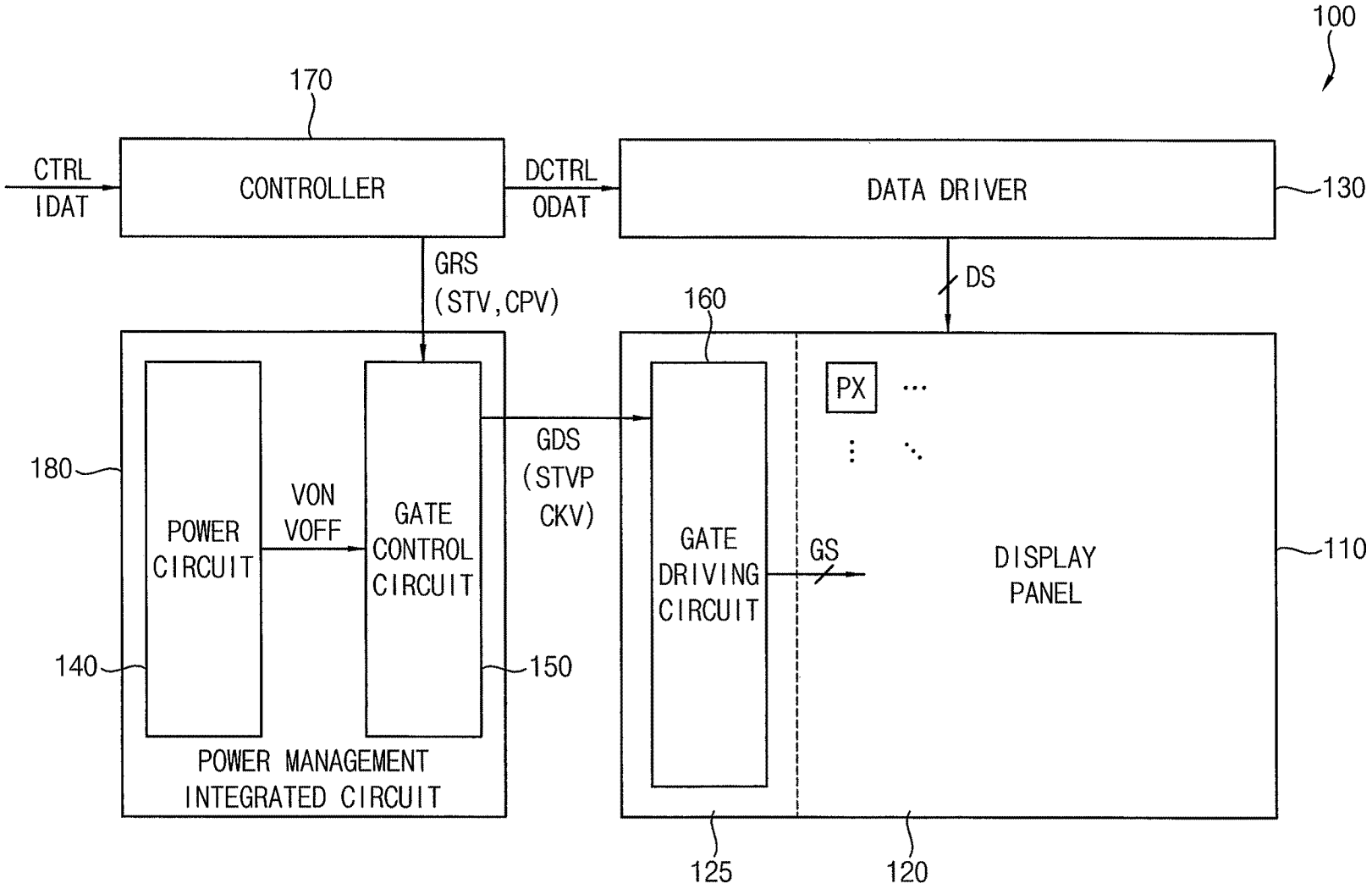
FIG. 1 is a block diagram illustrating a display device according to exemplary embodiments.
Figure 2:
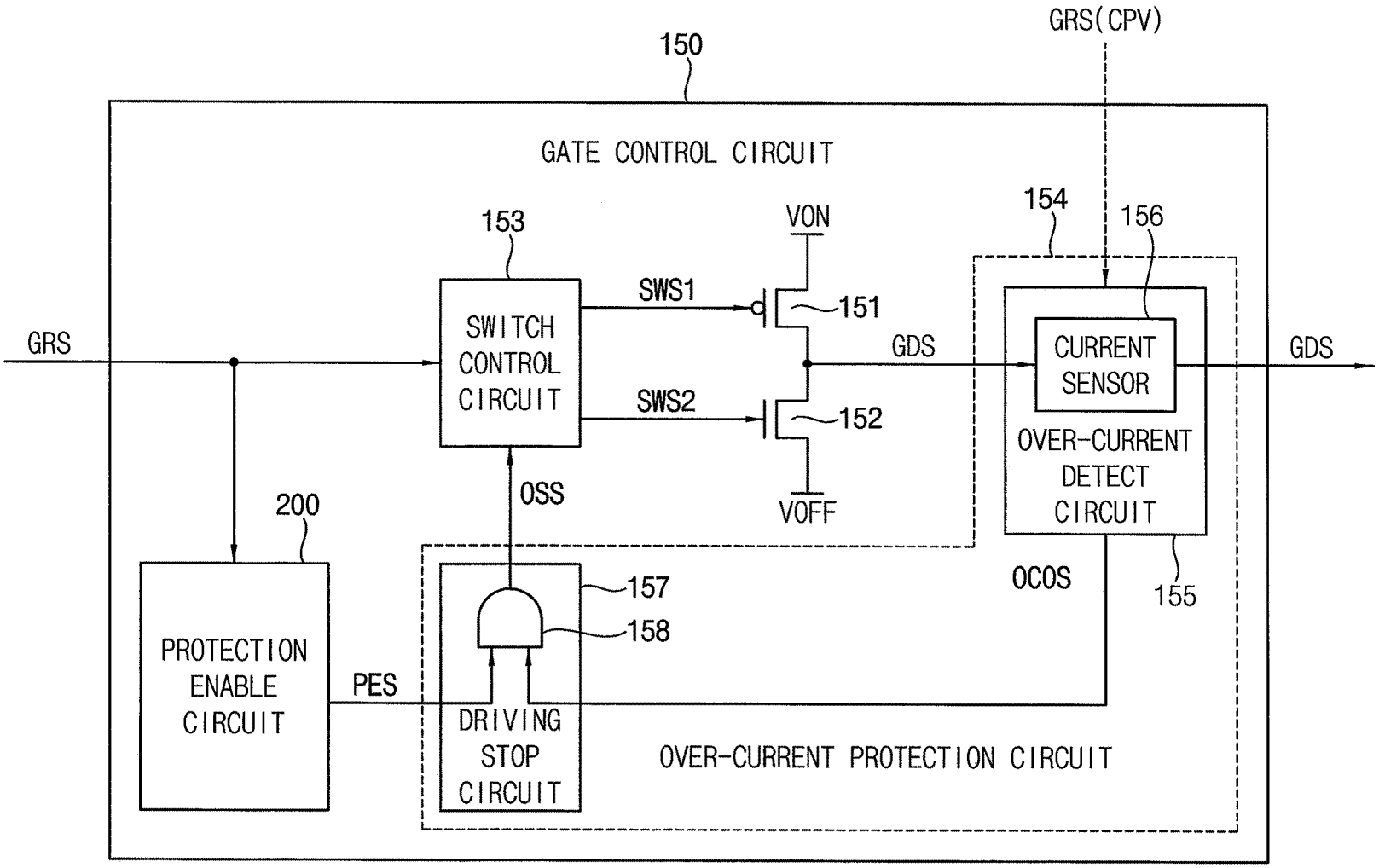
FIG. 2 is a block diagram illustrating an exemplary embodiment of a gate control circuit included in the display device of FIG. 1.
Figure 3:
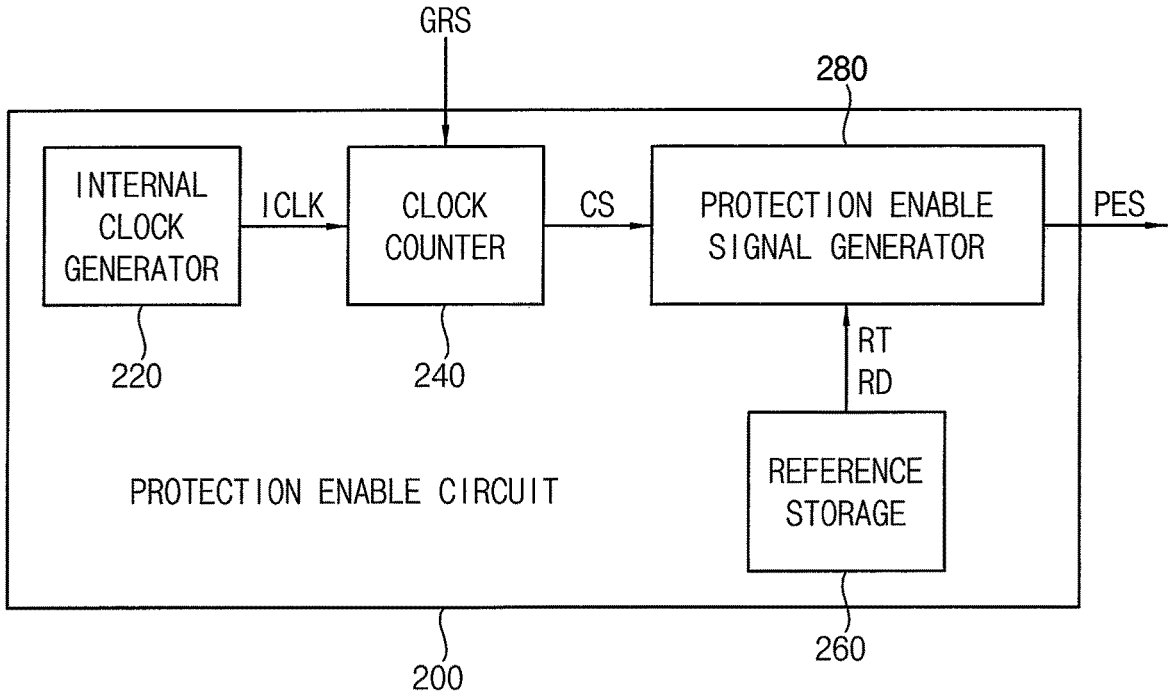
FIG. 3 is a block diagram illustrating an exemplary embodiment of a protection enable circuit included in the gate control circuit of FIG. 2.
Figure 4:
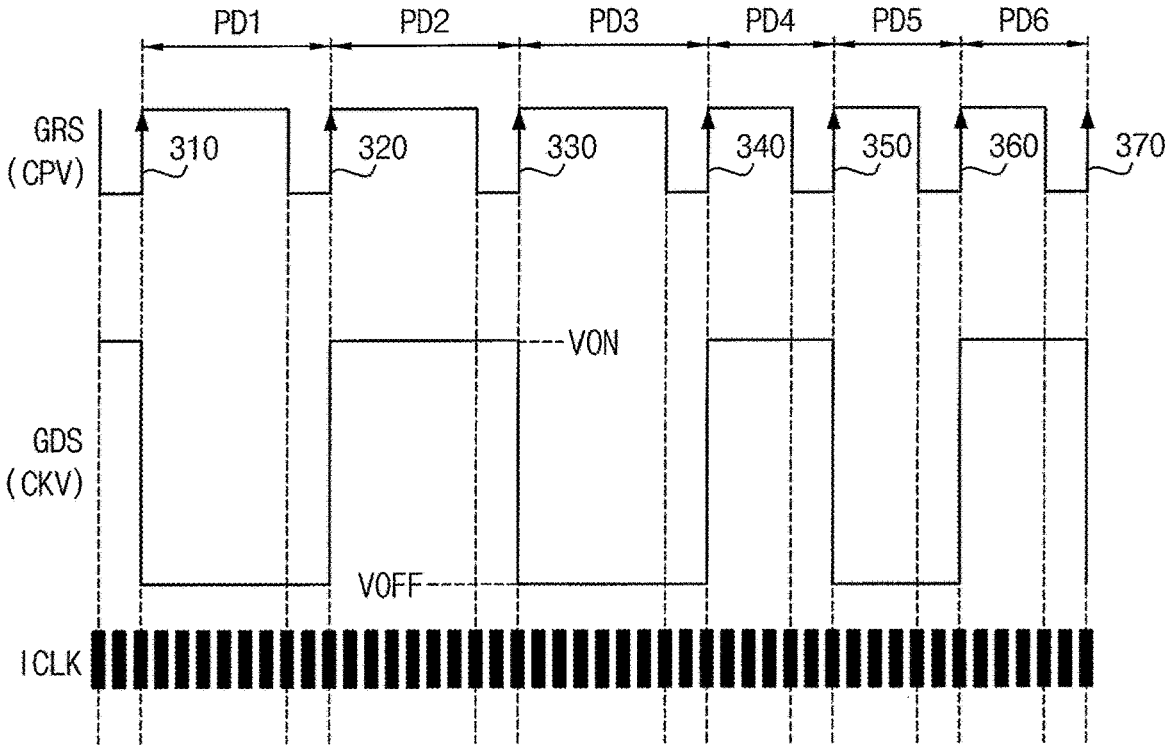
FIG. 4 is a timing diagram for describing an example of an operation of a gate control circuit included in a display device according to exemplary embodiments.
Figure 5:
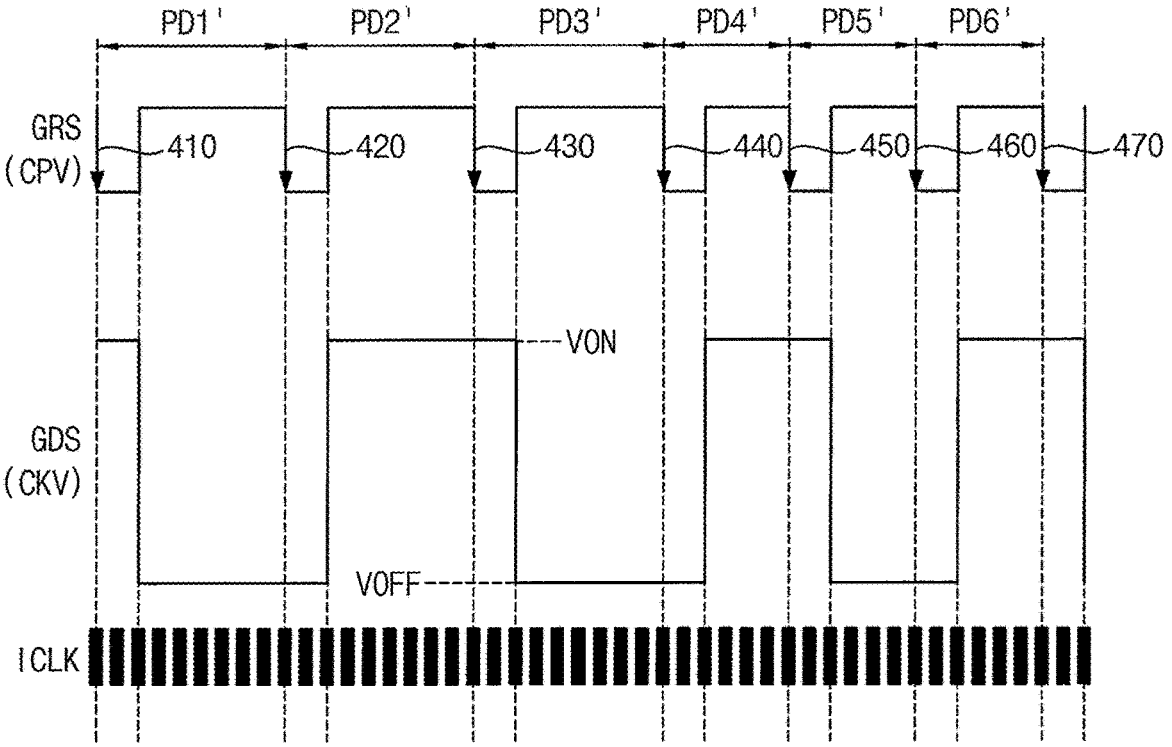
FIG. 5 is a timing diagram for describing another example of an operation of a gate control circuit included in a display device according to exemplary embodiments.

FIG. 1 is a block diagram illustrating a display device according to exemplary embodiments, FIG. 2 is a block diagram illustrating an exemplary embodiment of a gate control circuit included in the display device of FIG. 1, FIG. 3 is a block diagram illustrating an exemplary embodiment of a protection enable circuit included in the gate control circuit of FIG. 2, FIG. 4 is a timing diagram for describing an example of an operation of a gate control circuit included in a display device according to exemplary embodiments, and FIG. 5 is a timing diagram for describing another example of an operation of a gate control circuit included in a display device according to exemplary embodiments.

Referring to FIG. 1, a display device 100 according to exemplary embodiments may include a display panel 110 including a plurality of pixels PX, a data driver 130 providing data signals DS to the plurality of pixels PX, a power circuit 140 generating voltages for driving the display panel 110, a gate control circuit 150 generating a gate driving signal GDS, a gate driving circuit 160 providing gate signals GS to the plurality of pixels PX based on the gate driving signal GDS, and a controller 170 controlling an operation of the display device 100.

The display panel 110 may have a display region 120 in which an image is displayed, and a peripheral region 125 adjacent to the display region 120. The display panel 110 may include the plurality of pixels PX in the display region 120. In some exemplary embodiments, the display panel 110 may be a liquid crystal display ("LCD") panel where each pixel PX includes a switching transistor and a liquid crystal capacitor coupled to the switching transistor. In another exemplary embodiment, the display panel 110 may be an organic light emitting diode ("OLED") display panel where each pixel PX includes at least two transistors, at least one capacitor and an OLED. However, the display panel 110 according to the invention may not be limited to the LCD panel and the OLED display panel, and may be any suitable display panel.

The data driver 130 may provide the data signals DS to the plurality of pixels PX based on a data control signal DCTRL and output image data ODAT received from the controller 170. In some exemplary embodiments, the data control signal DCTRL may include, but not limited to, an output data-enable signal and a load signal. In some exemplary embodiments, the data driver 130 may be implemented with one or more data driver integrated circuits ("ICs"). For example, the one or more data driver ICs may be mounted on a flexible film coupled to the display panel 110 in a chip on film ("COF") manner, or may be mounted on the display panel 110 in a chip on glass ("COG") manner or a chip on plastic ("COP") manner.

The power circuit 140 may receive an input voltage from an external power source, and may convert the input voltage into the voltages for driving the display panel 110. In some exemplary embodiments, the power circuit 140 may generate a gate-on voltage VON and a gate-off voltage VOFF based on the input voltage, and may provide the gate-on voltage VON and the gate-off voltage VOFF to the gate control circuit 150. For example, the gate-on voltage VON may be, but not limited to, about 30 volts (V), and the gate-off voltage VOFF may be, but not limited to, about −10V.

The gate control circuit 150 may receive a gate reference signal GRS from the controller 170, may generate the gate driving signal GDS based on the gate reference signal GRS, and may provide the gate driving signal GDS to the gate driving circuit 160. As used herein, the term "gate driving signal" refers to a signal provided from the gate control circuit 150 to the gate driving circuit 160 and measured by current and voltage. In some exemplary embodiments, the gate control circuit 150 may receive the gate-on voltage VON and the gate-off voltage VOFF from the power circuit 140, and may generate the gate driving signal GDS having a voltage level suitable for the gate driving circuit 160 based on the gate-on voltage VON and the gate-off voltage VOFF.

In some exemplary embodiments, the gate reference signal GRS may include a reference start signal STV, and the gate control circuit 150 may generate, as the gate driving signal GDS, a gate start signal STVP having a voltage level suitable for the gate driving circuit 160 by changing a voltage level of the reference start signal STV based on the gate-on voltage VON and the gate-off voltage VOFF. Further, in some exemplary embodiments, the gate reference signal GRS may include a reference clock signal CPV, and the gate control circuit 150 may generate, as the gate driving signal GDS, one or more gate clock signals CKV having a voltage level suitable for the gate driving circuit 160 based on the reference clock signal CPV, the gate-on voltage VON and the gate-off voltage VOFF. For example, the gate control circuit 150 may receive four reference clock signals CPV, and may generate eight gate clock signals CKV having different phases based on the four reference clock signals CPV. However, the number of the gate clock signals CKV output from the gate control circuit 150 may be varied according to exemplary embodiments.

In some exemplary embodiments, as illustrated in FIG. 1, the power circuit 140 and the gate control circuit 150 may be provided in a power management integrated circuit ("PMIC") 180. In other exemplary embodiments, the power circuit 140 and the gate control circuit 150 may be implemented with separate integrated circuits from each other.

The gate driving circuit 160 may sequentially provide the gate signals GS to the plurality of pixels PX on a row-by-row basis, respectively, based on the gate driving signal GDS. In some exemplary embodiments, the gate driving circuit 160 may receive, as gate driving signal GDS, the gate start signal STVP representing a start of a scan operation and the one or more gate clock signals CKV having different phases from each other, and may sequentially provide the gate signals GS to the plurality of pixels PX on the row-by-row basis, respectively, based on the gate start signal STVP and the one or more gate clock signals CKV.

In some exemplary embodiments, the gate driving circuit 160 may be implemented as an amorphous silicon gate ("ASG") circuit using an amorphous silicon thin film transistor ("a-Si TFT"), and may be integrated in the peripheral portion 125 of the display panel 110 as illustrated in FIG. 1. In other exemplary embodiments, the gate driving circuit 160 may be implemented with one or more gate driver ICs. Further, the one or more gate driver ICs may be mounted on a flexible film coupled to the display panel 110 in a COF manner, or may be mounted on the display panel 110 in a COG manner or a COP manner.

The controller 170 (e.g., a timing controller ("TCON")) may receive a control signal CTRL and input image data IDAT from an external host processor (e.g., a graphic processing unit ("GPU") or a graphic card). For example, the control signal CTRL may include, but not limited to, a vertical synchronization signal, a horizontal synchronization signal, an input data enable signal, a master clock signal, etc. Further, for example, the input image data IDAT may be, but not limited to, RGB image data including red image data, green image data and blue image data. The controller 170 may generate the gate reference signal GRS, the data control signal DCTRL and the output image data ODAT based on the control signal CTRL and the input image data IDAT. The controller 170 may control operations of the gate control circuit 150 and the gate driving circuit 160 by providing the gate reference signal GRS to the gate control circuit 150, and may control an operation of the data driver 130 by providing the data control signal DCTRL and the output image data ODAT to the data driver 130.

In the display device 100 according to exemplary embodiments, the gate control circuit 150 may perform an over-current protection operation that stops driving the display panel 110 by detecting an over-current of the gate driving signal GDS provided to the gate driving circuit 160. As used herein, the term "over-current" refers to a current greater than or equal to a reference current. Further, to prevent the over-current protection operation from being undesirably performed when the gate reference signal GRS is abnormal, the gate control circuit 150 included in the display device 100 according to exemplary embodiments may selectively enable the over-current protection operation by detecting a period of the gate reference signal GRS. Thus, while the over-current protection operation is enabled, the over-current protection operation may be performed when the over-current is detected. However, while the over-current protection operation is disabled, the over-current protection operation may not be performed even if the over-current is detected. To perform these operations, as illustrated in FIG. 2, the gate control circuit 150 may include a first switch 151, a second switch 152, a switch control circuit 153, an over-current protection circuit 154 and a protection enable circuit 200.

The first switch 151 may output the gate-on voltage VON as the gate driving signal GDS in response to a first switching signal SWS1, and the second switch 152 may output the gate-off voltage VOFF as the gate driving signal GDS in response to a second switching signal SWS2. In some exemplary embodiments, as illustrated in FIG. 2, the first switch 151 may be implemented with a p-type transistor, and the second switch 152 may be implemented with an n-type transistor. To control the first and second switches 151 and 152, the switch control circuit 153 may generate the first and second switching signals SWS1 and SWS2 in response to the gate reference signal GRS.

In an example, the gate reference signal GRS may include the reference start signal STV, and the gate driving signal GDS may include the gate start signal STVP. The switch control circuit 153 may generate the first switching signal SWS1 having a high level and the second switching signal SWS2 having a low level to output the gate-on voltage VON as the gate start signal STVP while the reference start signal STV has a high level, and may generate the first switching signal SWS1 having a low level and the second switching signal SWS2 having a high level to output the gate-off voltage VOFF as the gate start signal STVP while the reference start signal STV has a low level. Accordingly, the gate control circuit 150 may generate the gate start signal STVP that has a phase substantially the same as a phase of the reference start signal STV, and has a voltage level suitable for the gate driving circuit 160. For example, when the reference start signal STV may have about 3.3V as a high level and about 0V as a low level, the gate start signal STVP may have about 30V as a high level and about −10V as a low level.

In another example, the gate reference signal GRS may include the reference clock signal CPV, and the gate driving signal GDS may include the gate clock signal CKV. As illustrated in FIGS. 4 and 5, the gate control circuit 150 may change a voltage level of the gate clock signal CKV from a high level to a low level or from a low level to a high level at each rising edge 310 through 370 of the reference clock signal CPV. For example, the switch control circuit 153 may generate the first switching signal SWS1 having the low level and the second switching signal SWS2 having the high level to output the gate-off voltage VOFF as the gate clock signal CKV at odd-numbered rising edges 310, 330, 350 and 370, and may generate the first switching signal SWS1 having the high level and the second switching signal SWS2 having the low level to output the gate-on voltage VON as the gate clock signal CKV at even-numbered rising edges 320, 340 and 360. Accordingly, the gate control circuit 150 may generate the gate clock signal CKV having a voltage level suitable for the gate driving circuit 160 based on the reference clock signal CPV. For example, the reference clock signal CPV may have about 3.3V as the high level and about 0V as the low level, and the gate clock signal CKV may have about 30V as the high level and about −10V as the low level. Further, in some exemplary embodiments, at falling edges 410 through 470 of the reference clock signal CPV, the gate control circuit 150 may connect a line for outputting the gate clock signal CKV to a ground line, or may perform a charge share operation for the gate clock signal CKV. In this case, since the gate control circuit 150 may change the voltage level of the gate clock signal CKV from a predetermined voltage level (e.g., a ground voltage level) to a high level or a low level at the rising edges 310 through 370 of the reference clock signal CPV, power consumption of the gate control circuit 150 may be reduced.

Although FIG. 2 illustrates an example of the gate control circuit 150 including two switches 151 and 152 for outputting one gate driving signal GDS, the number of the switches included in the gate control circuit 150 may not be limited to the example of FIG. 2. In another exemplary embodiment, the number of the switches may be determined depending on the number of the gate driving signal GDS. For example, to output one gate start signal STVP and eight gate clock signals CKV as the gate driving signal GDS, the gate control circuit 150 may include eighteen switches.

The over-current protection circuit 154 may detect the over-current of the gate driving signal GDS, and may perform the over-current protection operation that stops driving the display panel 110 in response to the detection of the over-current while a protection enable signal PES from the protection enable circuit 200 has a high level. To perform these operations, the over-current protection circuit 154 may include an over-current detect circuit 155 and a driving-stop circuit 157.

The over-current detect circuit 155 may measure a current of the gate driving signal GDS, may compare the measured current of the gate driving signal GDS with a reference current, and may generate an over-current occurrence signal OCOS representing that the over-current of the gate driving signal GDS is detected when the measured current is greater than or equal to the reference current. In some exemplary embodiments, the over-current detect circuit 155 may include, but not limited to, a current sensor 156 for measuring the current of the gate driving signal GDS.

In some exemplary embodiments, the over-current detect circuit 155 may receive the gate reference signal GRS (e.g., the reference clock signal CPV), and may measure the current of the gate driving signal GDS in response to the gate reference signal GRS to detect the over-current of the gate driving signal GDS. For example, in response to the gate reference signal GRS, the over-current detect circuit 155 may measure the current of the gate driving signal GDS after a predetermined time from a time point at which the gate driving signal GDS becomes a high level. In an example, the over-current detect circuit 155 may measure the current of the gate driving signal GDS after the predetermined time from the even-numbered rising edges 320, 340 and 360 of the reference clock signal CPV illustrated in FIG. 4. In a case where a line of the gate clock signal CKV does not have a short-circuit defect, a current of the gate clock signal CKV may be rapidly increased at the even-numbered rising edges 320, 340 and 360 of the reference clock signal CPV, but the current of the gate clock signal CKV may be decreased to less than the reference current after the predetermined time. However, in a case where the short-circuit defect occurs in the line of the gate clock signal CKV, the current of the gate clock signal CKV may remain greater than the reference current even after the predetermined time from the even-numbered rising edges 320, 340 and 360 of the reference clock signal CPV. In this case, the over-current detect circuit 155 may determine that the over-current of the gate driving signal GDS occurs, and may generate the over-current occurrence signal OCOS representing that the over-current of the gate driving signal GDS is detected.

The driving-stop circuit 157 may generate an output-stop signal OSS representing that outputting the gate driving signal GDS is to be stopped, in response to the over-current occurrence signal OCOS representing that the over-current of the gate driving signal GDS is detected and the protection enable signal PES representing that the over-current protection operation is enabled. In some example embodiments, the driving-stop circuit 157 may include, but not limited to, an AND gate 158 that generates the output-stop signal OSS having a high level by performing an AND operation on the over-current occurrence signal OCOS having a high level and the protection enable signal PES having an high level. In some exemplary embodiments, the switch control circuit 153 may turn off the first and second switches 151 and 152 in response to the output-stop signal OSS having the high level received from the driving-stop circuit 157, and thus outputting the gate driving signal GDS may be stopped. In some exemplary embodiments, the driving-stop circuit 157 may provide the output-stop signal OSS further to the power circuit 140, and, therefore, the power circuit 140 may stop generating the voltages for driving the display panel 110 in response to the output-stop signal OSS. In other exemplary embodiments, the driving-stop circuit 157 may provide the output-stop signal OSS further to the controller 170, and, therefore, the controller 170 may control the display device 100 to stop driving the display panel 110 in response to the output-stop signal OSS.

The protection enable circuit 200 may detect a period of the gate reference signal GRS, may determine whether the period of the gate reference signal GRS is changed, and may generate the protection enable signal PES representing that the over-current protection operation is enabled when the period of the gate reference signal GRS is not changed. Further, when the period of the gate reference signal GRS is changed, the protection enable circuit 200 may not generate the protection enable signal PES, or may generate the protection enable signal PES having a low level, so that the over-current protection circuit 154 may not perform the over-current protection operation that stops outputting the gate driving signal GDS or stops driving the display panel 110.

In some exemplary embodiments, the protection enable circuit 200 may determine that the period of the gate reference signal GRS is not changed when consecutive periods of the gate reference signal GRS detected for a reference number of periods RT have a time difference from each other less than a reference time difference. The protection enable circuit 200, then, may generate the protection enable signal PES representing that the over-current protection operation is enabled for the next period. To perform these operations, as illustrated in FIG. 3, the protection enable circuit 200 may include an internal clock generator 220, a clock counter 240, a reference storage 260 and a protection-enable-signal generator 280.

The internal clock generator 220 may generate an internal clock signal ICLK having a predetermined clock frequency. The clock counter 240 may count the number of clocks of the internal clock signal ICLK during each period of the gate reference signal GRS, and may output a counting signal CS representing the counted number of the clocks of the internal clock signal ICLK. The reference storage 260 may store the reference number of periods RT, and a reference clock number difference RD corresponding to the reference time difference. The protection-enable-signal generator 280 may generate the protection enable signal PES when the counting signals CS of which the number corresponds to the reference number of periods RT have a clock number difference from each other less than the reference clock number difference RD. In some exemplary embodiments, the reference number of periods RT and/or the reference time difference (or the reference clock number difference RD corresponding to the reference time difference) may be settable. For example, the controller 170 may provide a new reference number of periods RT and a new reference clock number difference RD to the protection enable circuit 200, and the reference number of periods RT and the reference clock number difference RD stored in the reference storage 260 of the protection enable circuit 200 may be updated to the new reference number of periods RT and the new reference clock number difference RD.

In some exemplary embodiments, the protection enable circuit 200 may detect, as the period of the gate reference signal GRS, a time interval between adjacent rising edges of the gate reference signal GRS. In an example of FIG. 4, the internal clock generator 220 may generate the internal clock signal ICLK, the clock counter 240 may output the counting signal CS representing a first number of clocks of the internal clock signal ICLK between a first rising edge 310 and a second rising edge 320 of the gate reference signal GRS, and the protection-enable-signal generator 280 may store the first number of clocks between the first and second rising edges 310 and 320 as a first period PD1 of the gate reference signal GRS. Further, the protection-enable-signal generator 280 may store a second number of clocks between second and third rising edges 320 and 330 as a second period PD2 of the gate reference signal GRS, and may store a third number of clocks between third and fourth rising edges 330 and 340 as a third period PD3 of the gate reference signal GRS. In a case where the reference number of periods RT stored in the reference storage 260 is three periods, the protection-enable-signal generator 280 may determine whether the first through three numbers of clocks have a difference from each other less than the reference clock number difference RD, and may generate the protection enable signal PES representing that the over-current protection operation is enabled for the next period when the first through three numbers of clocks have the difference from each other less than the reference clock number difference RD.

Further, the protection-enable-signal generator 280 may store a fourth number of clocks between fourth and fifth rising edges 340 and 350 as a fourth period PD4 of the gate reference signal GRS, and may determine whether the second through fourth numbers of clocks have a difference from each other less than the reference clock number difference RD in the case where the reference number of periods RT stored in the reference storage 260 is three periods. In a case where any two of the second through fourth numbers of clocks have a difference greater than or equal to the reference clock number difference RD, the protection enable circuit 200 may not generate the protection enable signal PES, or may generate the protection enable signal PES having a low level for the next period. Even if the over-current of the gate driving signal GDS is detected, the over-current protection circuit 154 may not generate the output-stop signal OSS in response to the protection enable signal PES having the low level. For example, is a case where the fourth period PD4 of the gate reference signal GRS is different from the first through third periods PD1 through PD3 that are the same as shown in FIG. 4, the current of the gate clock signal CKV that is detected by the over-current detect circuit 155 in response to the fifth rising edge 350 may be greater than or equal to the reference current even if the line of the gate clock signal CKV does not have the short-circuit defect, and thus the over-current detect circuit 155 may generate the over-current occurrence signal OCOS. However, the driving-stop circuit 157 may not generate the output-stop signal OSS based on the protection enable signal PES having the low level. Accordingly, even if the abnormal gate reference signal GRS is applied from the controller 170 to the gate control circuit 150, the over-current protection operation may not be undesirably performed.

In this manner, while the display device 100 operates, the protection enable circuit 200 may count the number of clocks of the internal clock signal ICLK between adjacent rising edges with respect to each of the periods PD1 through PD6 of the gate reference signal GRS, and determine whether the numbers of clocks corresponding to the reference number of periods RT have a difference from each other less than the reference clock number difference RD at each of the periods PD1 through PD6 of the gate reference signal GRS, or at each of the rising edges 310 through 370 of the gate reference signal GRS.

In other exemplary embodiments, the protection enable circuit 200 may detect, as the period of the gate reference signal GRS, a time interval between adjacent falling edges of the gate reference signal GRS. In an example of FIG. 5, the protection enable circuit 200 may count the number of clocks of the internal clock signal ICLK between first and second falling edges 410 and 420 as a first period PD1' of the gate reference signal GRS, may count the number of clocks of the internal clock signal ICLK between second and third falling edges 420 and 430 as a second period PD2' of the gate reference signal GRS, may count the number of clocks of the internal clock signal ICLK between third and fourth falling edges 430 and 440 as a third period PD3' of the gate reference signal GRS, may count the number of clocks of the internal clock signal ICLK between fourth and fifth falling edges 440 and 450 as a fourth period PD4' of the gate reference signal GRS, may count the number of clocks of the internal clock signal ICLK between fifth and sixth falling edges 450 and 460 as a fifth period PD5' of the gate reference signal GRS, and may count the number of clocks of the internal clock signal ICLK between sixth and seventh falling edges 460 and 470 as a sixth period PD6' of the gate reference signal GRS. Further, while the display device 100 operates, the protection enable circuit 200 may determine whether the numbers of clocks corresponding to the reference number of periods RT have a difference from each other less than the reference clock number difference RD at each of the periods PD1' through PD6' of the gate reference signal GRS, or at each of the falling edges 410 through 470 of the gate reference signal GRS.

In a case where the abnormal gate reference signal GRS is applied from the controller 170 to the gate control circuit 150, or in a case where the period of the gate reference signal GRS is changed, the over-current detect circuit 155 may generate the over-current occurrence signal OCOS even if the line of the gate clock signal CKV does not have the short-circuit defect. However, as described above, in the display device 100 according to exemplary embodiments, the protection enable circuit 200 may detect the period of the gate reference signal GRS, and the over-current protection circuit 154 may perform the over-current protection operation only when the period of the gate reference signal GRS is not changed and the over-current of the gate driving signal GDS is detected. Accordingly, in the display device 100 according to exemplary embodiments, even if the gate reference signal GRS is abnormal, the over-current protection operation may be prevented from being undesirably performed.

Figure 6:
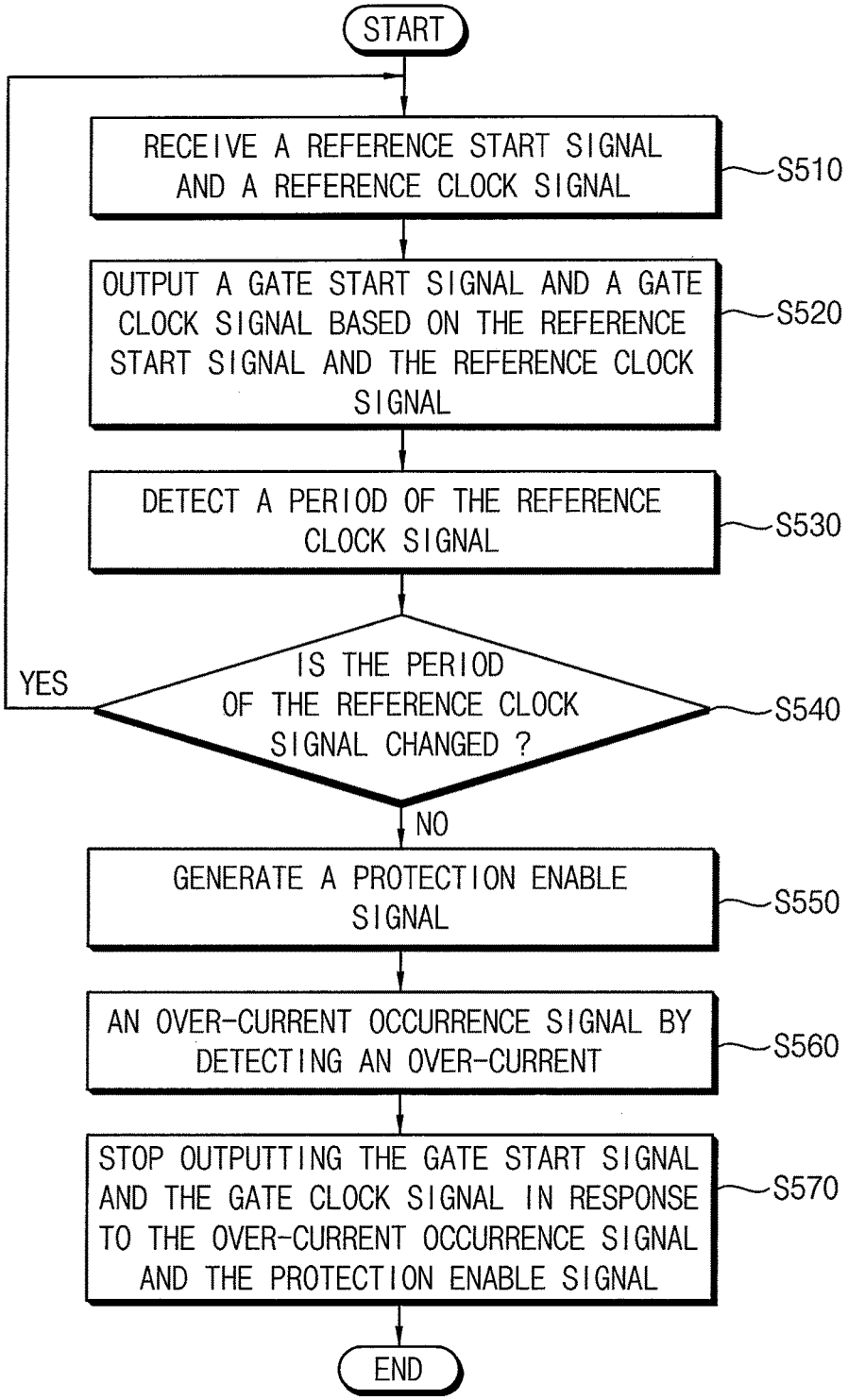
FIG. 6 is a flowchart illustrating a method of protecting an over-current according to exemplary embodiments.
Figure 7:
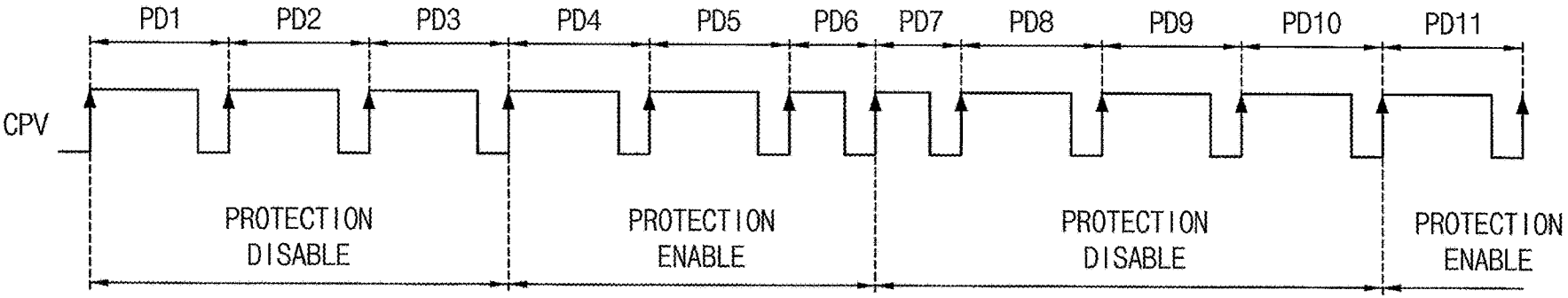
FIG. 7 is a timing diagram for describing an example where a protection enable signal is generated by detecting a period of a reference clock signal according to exemplary embodiments.

FIG. 6 is a flowchart illustrating a method of protecting an over-current according to exemplary embodiments, and FIG. 7 is a timing diagram for describing an example where a protection enable signal is generated by detecting a period of a reference clock signal according to exemplary embodiments.

Referring to FIGS. 1, 2, 3 and 6, a gate control circuit 150 may receive a reference start signal STV and a reference clock signal CPV from a controller 170 (S510). The gate control circuit 150 may output a gate start signal STVP and a gate clock signal CKV based on the reference start signal STV and the reference clock signal CPV (S520). A gate driving circuit 160 may provide gate signals GS to a plurality of pixels PX of a display panel 110 based on the gate start signal STVP and the gate clock signal CKV.

A protection enable circuit 200 may detect a period of the reference clock signal CPV (S530). For example, to detect the period of the reference clock signal CPV, an internal clock generator 220 may generate an internal clock signal ICLK, and a clock counter 240 may count the number of clocks of the internal clock signal ICLK during each period of the gate clock signal CPV.

If the period of the reference clock signal CPV is changed (S540: YES), the protection enable circuit 200 may not generate a protection enable signal PES, and an over-current protection operation of an over-current protection circuit 154 may be disabled.

If the period of the reference clock signal CPV is not changed (S540: NO), the protection enable circuit 200 may generate the protection enable signal PES representing that the over-current protection operation is enabled (S550), an over-current detect circuit 155 of the over-current protection circuit 154 may generate an over-current occurrence signal OCOS by detecting an over-current of the gate start signal STVP and/or the gate clock signal CKV (S560), a driving-stop circuit 157 of the over-current protection circuit 154 may generate an output-stop signal OSS in response to the over-current occurrence signal OCOS and the protection enable signal PES, and a switch control circuit 153 may control switches 151 and 152 not to output the gate start signal STVP and the gate clock signal CKV in response to the output-stop signal OSS (S570).

In some exemplary embodiments, the protection enable circuit 200 may determine that the period of the reference clock signal CPV is not changed when consecutive periods of the reference clock signal CPV detected for a reference number of periods RT have a time difference from each other less than a reference time difference. FIG. 7 illustrates an example where the reference number of periods RT is three periods. In the example of FIG. 7, if first through third periods PD1, PD2 and PD3 of the reference clock signal CPV have a time difference from each other less than the reference time difference, the protection enable circuit 200 may generate the protection enable signal PES representing that the over-current protection operation is enabled for the fourth period PD4. The protection enable circuit 200 may determine whether a time difference between the periods of which the number corresponds to the reference number of periods RT is less than the reference time difference at each of the periods PD1 through PD11 of the reference clock signal CPV. Whether the over-current protection operation is enabled for a period is determined by a comparison of three previous periods. For example, the over-current protection operation is disabled for the first to third periods PD1 to PD3 since there are no three previous periods for these periods. In another example, in a case where any two of fourth through sixth periods PD4, PD5 and PD6 of the reference clock signal CPV have a time difference greater than or equal to the reference time difference (e.g., the sixth period PD6 is different from the each of the fourth and fifth periods PD4 and PD5 greater than or equal to the reference time difference), the protection enable circuit 200 may not generate the protection enable signal PES, or may generate the protection enable signal PES having a low level so as to make the over-current protection operation disabled for the next period, the seventh period PD7. In a case where the reference clock signal CPV is abnormal, or in a case where the period of the reference clock signal CPV is changed, a corresponding over-current protection circuit of a conventional display device may undesirably perform the over-current protection operation even if a line of the gate clock signal CKV does not have a short-circuit defect. However, in the display device 100 according to exemplary embodiments, the protection enable circuit 200 may disable the over-current protection operation of the over-current protection circuit 154 in the case where the period of the reference clock signal CPV is changed, thereby preventing the over-current protection operation from being undesirably performed. Further, if eighth through tenth periods PD8, PD9 and PD10 of the reference clock signal CPV have a time difference from each other less than the reference time difference, the protection enable circuit 200 may again generate the protection enable signal PES representing that the over-current protection operation is enabled for the next period, the eleventh period PD11.

Figure 8:
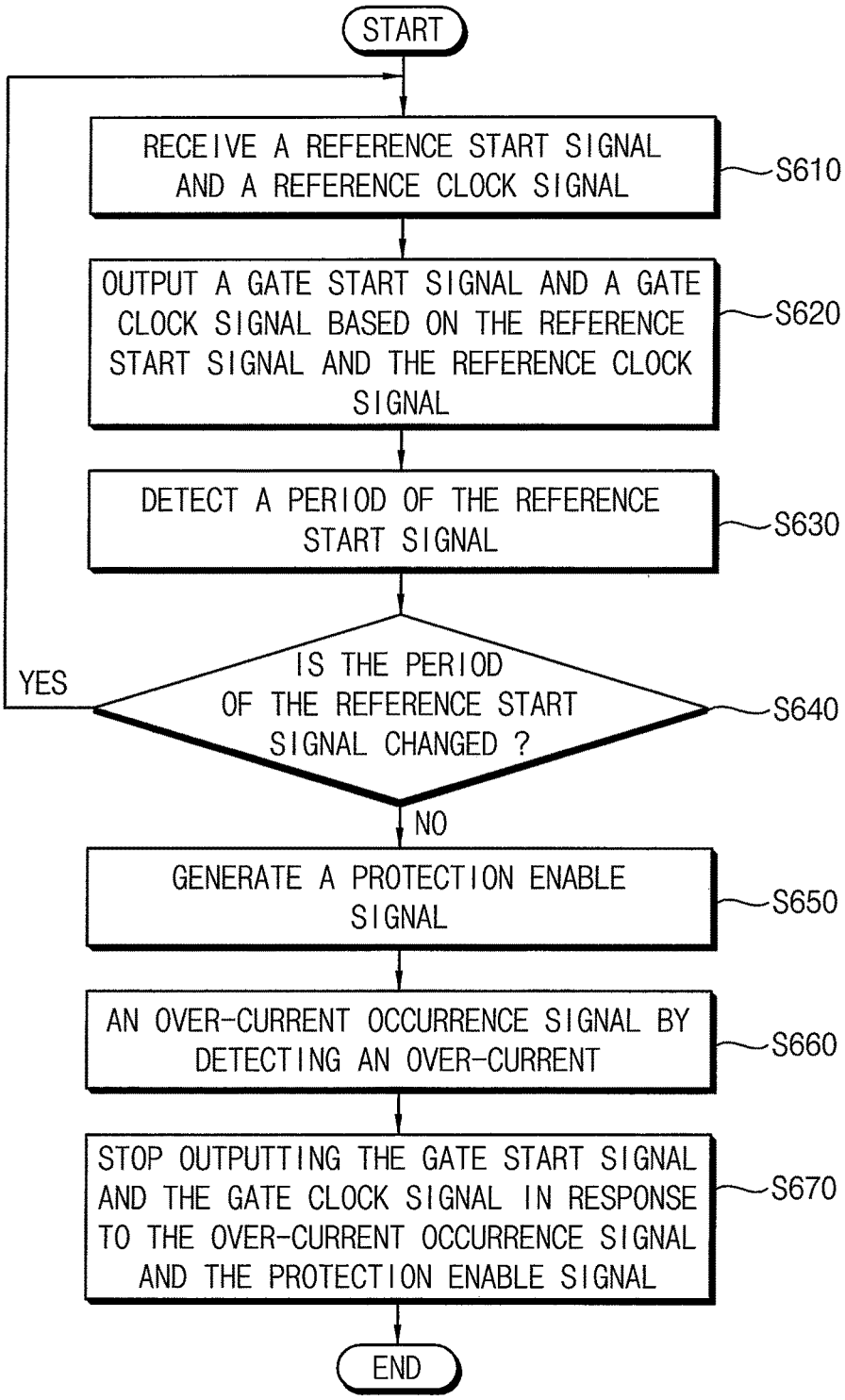
FIG. 8 is a flowchart illustrating a method of protecting an over-current according to exemplary embodiments.
Figure 9:
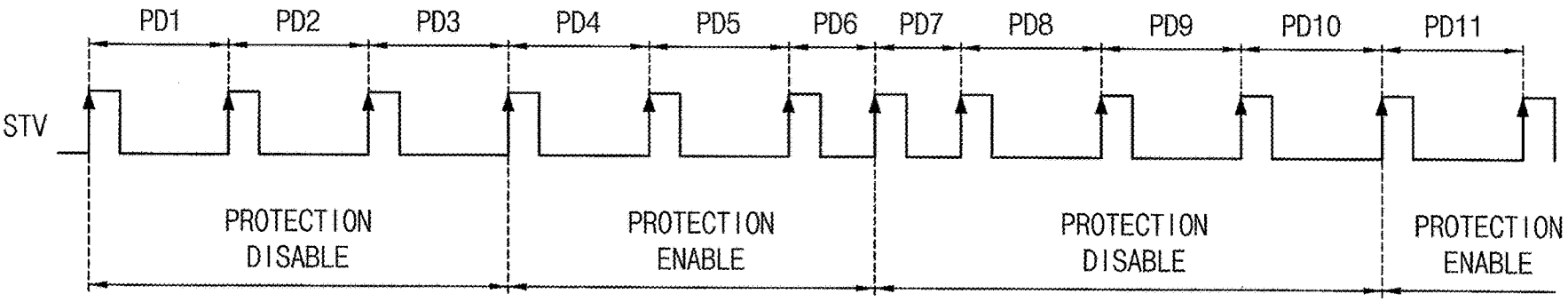
FIG. 9 is a timing diagram for describing an example where a protection enable signal is generated by detecting a period of a reference start signal according to exemplary embodiments.

FIG. 8 is a flowchart illustrating a method of protecting an over-current according to exemplary embodiments, and FIG. 9 is a timing diagram for describing an example where a protection enable signal is generated by detecting a period of a reference start signal according to exemplary embodiments.

Referring to FIGS. 1, 2, 3 and 8, a gate control circuit 150 may receive a reference start signal STV and a reference clock signal CPV from a controller 170 (S610). The gate control circuit 150 may output a gate start signal STVP and a gate clock signal CKV based on the reference start signal STV and the reference clock signal CPV (S620). A gate driving circuit 160 may provide gate signals GS to a plurality of pixels PX of a display panel 110 based on the gate start signal STVP and the gate clock signal CKV.

A protection enable circuit 200 may detect a period of the reference start signal STV (S630). For example, to detect the period of the reference start signal STV, an internal clock generator 220 may generate an internal clock signal ICLK, and a clock counter 240 may count the number of clocks of the internal clock signal ICLK during each period of the reference start signal STV.

If the period of the reference start signal STV is changed (S640: YES), the protection enable circuit 200 may not generate a protection enable signal PES, and an over-current protection operation of an over-current protection circuit 154 may be disabled.

If the period of the reference start signal STV is not changed (S640: NO), the protection enable circuit 200 may generate the protection enable signal PES representing that the over-current protection operation is enabled (S650), an over-current detect circuit 155 of the over-current protection circuit 154 may generate an over-current occurrence signal OCOS by detecting an over-current of the gate start signal STVP and/or the gate clock signal CKV (S660), a driving-stop circuit 157 of the over-current protection circuit 154 may generate an output-stop signal OSS in response to the over-current occurrence signal OCOS and the protection enable signal PES, and a switch control circuit 153 may control switches 151 and 152 not to output the gate start signal STVP and the gate clock signal CKV in response to the output-stop signal OSS (S670).

In some exemplary embodiments, the protection enable circuit 200 may determine that the period of the reference start signal STV is not changed when consecutive periods of the reference start signal STV detected for a reference number of periods RT have a time difference from each other less than a reference time difference. FIG. 9 illustrates an example where the reference number of periods RT is three periods. In the example of FIG. 9, if first through third periods PD1, PD2 and PD3 of the reference start signal STV have a time difference from each other less than the reference time difference, the protection enable circuit 200 may generate the protection enable signal PES representing that the over-current protection operation is enabled for the next period, the fourth period PD4. The protection enable circuit 200 may determine whether a time difference between the periods of which the number corresponds to the reference number of periods RT is less than the reference time difference at each of the periods PD1 through PD11 of the reference start signal STV. In a case where any two of fourth through sixth periods PD4, PD5 and PD6 of the reference start signal STV have a time difference greater than or equal to the reference time difference, the protection enable circuit 200 may not generate the protection enable signal PES, or may generate the protection enable signal PES having a low level for the next period, the seventh period PD7. In a case where the reference start signal STV is abnormal, or in a case where the period of the reference start signal STV is changed, the corresponding over-current protection circuit of a conventional display device may undesirably perform the over-current protection operation even if a line of the gate clock signal CKV does not have a short-circuit defect. However, in the display device 100 according to exemplary embodiments, the protection enable circuit 200 may disable the over-current protection operation of the over-current protection circuit 154 in the case where the period of the reference start signal STV is changed, thereby preventing the over-current protection operation from being undesirably performed. Further, if eighth through tenth periods PD8, PD9 and PD10 of the reference start signal STV have a time difference from each other less than the reference time difference, the protection enable circuit 200 may again generate the protection enable signal PES representing that the over-current protection operation is enabled for the next period, the eleventh period PD11.

Figure 10:
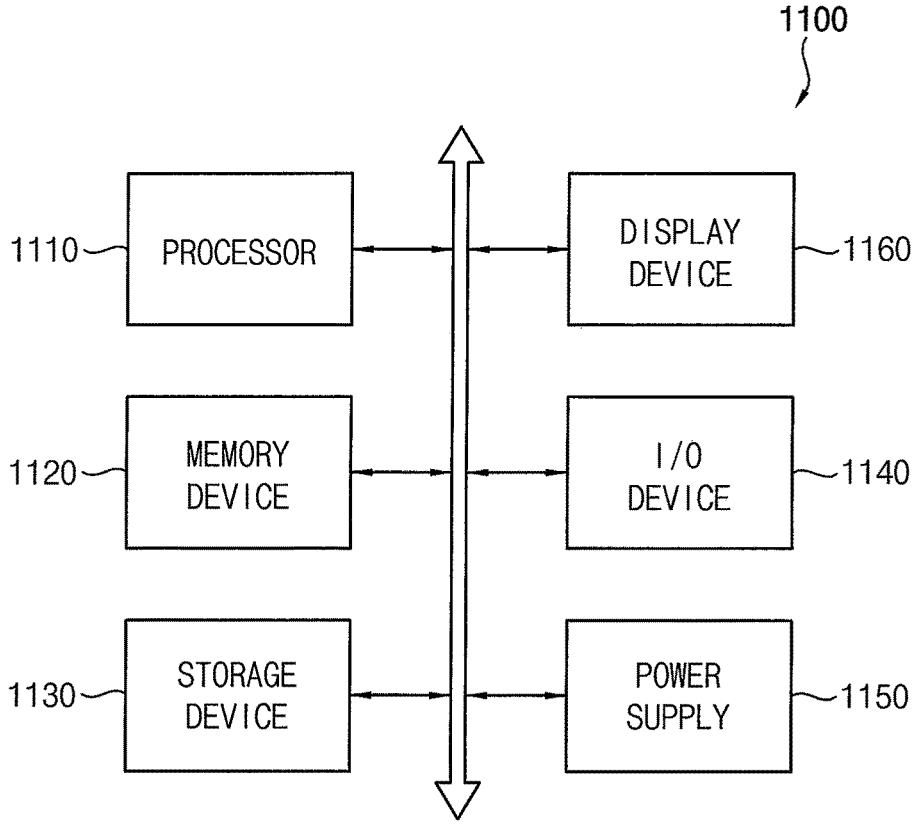
FIG. 10 is a block diagram illustrating an electronic device including a display device according to exemplary embodiments.

FIG. 10 is a block diagram illustrating an electronic device including a display device according to exemplary embodiments.

Referring to FIG. 10, an electronic device 1100 may include a processor 1110, a memory device 1120, a storage device 1130, an input/output ("I/O") device 1140, a power supply 1150, and a display device 1160. The electronic device 1100 may further include a plurality of ports for communicating a video card, a sound card, a memory card, a universal serial bus ("USB") device, other electric devices, etc.

The processor 1110 may perform various computing functions or tasks. The processor 1110 may be an application processor ("AP"), a micro processor, a central processing unit ("CPU"), etc. The processor 1110 may be coupled to other components via an address bus, a control bus, a data bus, etc. Further, in some exemplary embodiments, the processor 1110 may be further coupled to an extended bus such as a peripheral component interconnection ("PCI") bus. The processor 1110 may be used as the controller 170, the protection-enable-signal generator 280, etc.

The memory device 1120 may store data for operations of the electronic device 1100. For example, the memory device 1120 may include at least one non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc, and/or at least one volatile memory device such as a dynamic random access memory ("DRAM") device, a static random access memory ("SRAM") device, a mobile dynamic random access memory (mobile DRAM) device, etc.

The storage device 1130 may be a solid-state drive ("SSD") device, a hard disk drive ("HDD") device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The display device 1160 may be coupled to other components through the buses or other communication links. The memory device 1120 or the storage device 1130 may be used as the reference storage 260.

The display device 1160 may detect a period of a gate reference signal, and may perform an over-current protection operation when the period of the gate reference signal is not changed, and an over-current of a gate driving signal is detected. Accordingly, in the display device 1160 according to example embodiments, an undesired over-current protection operation may be prevented or may not be performed even if the gate reference signal is abnormal.

The inventive concepts may be applied to any display device 1160, and any electronic device 1100 including the display device 1160. For example, the inventive concepts may be applied to a television ("TV"), a digital TV, a 3D TV, a smart phone, a wearable electronic device, a tablet computer, a mobile phone, a personal computer ("PC"), a home appliance, a laptop computer, a personal digital assistant ("PDA"), a portable multimedia player ("PMP"), a digital camera, a music player, a portable game console, a navigation device, etc.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A display device comprising:

a display panel including a plurality of pixels;

a controller which generates a gate reference signal;

a gate control circuit which outputs a gate driving signal based on the gate reference signal; and a gate driving circuit which provides gate signals to the plurality of pixels based on the gate driving signal, wherein the gate control circuit comprises:

a protection enable circuit which detects a first period of the gate reference signal, determines whether the first period of the gate reference signal is changed, and generates a protection enable signal when the first period of the gate reference signal is not changed; and an over-current protection circuit which generates an over-current occurrence signal by detecting an over-current of the gate driving signal, and stops outputting the gate driving signal based on the over-current occurrence signal and the protection enable signal.

2. The display device of claim 1, wherein the protection enable circuit determines that the first period of the gate reference signal is not changed when consecutive periods of the gate reference signal detected for a reference number of periods including the first period have a time difference from each other less than a reference time difference.

3. The display device of claim 2, wherein the protection enable circuit comprises:

an internal clock generator which generates an internal clock signal;

a clock counter which counts the number of clocks of the internal clock signal during each period of the gate reference signal, and outputs a counting signal representing the counted number of the clocks of the internal clock signal;

a reference storage which stores the reference number of periods, and a reference clock number difference corresponding to the reference time difference; and a protection-enable-signal generator which generates the protection enable signal when the counting signals of which a number corresponds to the reference number of periods have a clock number difference from each other less than the reference clock number difference.

4. The display device of claim 2, wherein the reference number of periods is settable.

5. The display device of claim 2, wherein the reference time difference is settable.

6. The display device of claim 1, wherein the protection enable circuit detects, as the first period of the gate reference signal, a time interval between adjacent rising edges of the gate reference signal.

7. The display device of claim 1, wherein the protection enable circuit detects, as the first period of the gate reference signal, a time interval between adjacent falling edges of the gate reference signal.

8. The display device of claim 1, wherein the gate reference signal includes a reference clock signal, and wherein the gate control circuit generates a gate clock signal as the gate driving signal based on the reference clock signal, and outputs the gate clock signal to the gate driving circuit.

9. The display device of claim 8, wherein the protection enable circuit detects consecutive periods of the reference clock signal, determines whether the periods of the reference clock signal detected for a reference number of periods have a time difference from each other less than a reference time difference, and generates the protection enable signal when the periods of the reference clock signal have the time difference from each other less than the reference time difference.

10. The display device of claim 1, wherein the gate reference signal includes a reference start signal, and wherein the gate control circuit generates a gate start signal as the gate driving signal based on the reference start signal, and outputs the gate start signal to the gate driving circuit.

11. The display device of claim 10, wherein the protection enable circuit detects consecutive periods of the reference start signal, determines whether the periods of the reference start signals detected for a reference number of periods have a time difference from each other less than a reference time difference, and generates the protection enable signal when the periods of the reference start signal have the time difference from each other less than the reference time difference.

12. The display device of claim 1, wherein the over-current protection circuit comprises:

an over-current detect circuit which detects the over-current of the gate driving signal by comparing a current of the gate driving signal with a reference current, and generates the over-current occurrence signal when the over-current is detected; and a driving-stop circuit which generates an output-stop signal representing that outputting the gate driving signal is to be stopped based on the over-current occurrence signal and the protection enable signal.

13. The display device of claim 1, further comprising:

a power circuit which generates a gate-on voltage and a gate-off voltage, wherein the gate control circuit further comprises:

a first switch which outputs the gate-on voltage as the gate driving signal;

a second switch which outputs the gate-off voltage as the gate driving signal; and a switch control circuit which controls the first and second switches based on the gate reference signal.

14. The display device of claim 13, wherein the over-current protection circuit generates an output-stop signal based on the over-current occurrence signal and the protection enable signal, and wherein the switch control circuit turns off the first and second switches based on the output-stop signal.

15. The display device of claim 13, wherein the power circuit and the gate control circuit are disposed in a power management integrated circuit.

16. The display device of claim 1, wherein the gate driving circuit is disposed in a peripheral region of the display panel.

17. A display device comprising:

a display panel including a plurality of pixels;

a controller which generates a reference start signal and a reference clock signal;

a gate control circuit which outputs a gate start signal and a gate clock signal based on the reference start signal and the reference clock signal; and a gate driving circuit which provides gate signals to the plurality of pixels based on the gate start signal and the gate clock signal, wherein the gate control circuit comprises:

a protection enable circuit which detects a first period of the reference clock signal, determines whether the first period of the reference clock signal is changed, and generates a protection enable signal when the first period of the reference clock signal is not changed; and an over-current protection circuit which generates an over-current occurrence signal by detecting an over-current of the gate start signal or the gate clock signal, and stops outputting the gate start signal and the gate clock signal based on the over-current occurrence signal and the protection enable signal.

18. The display device of claim 17, wherein the protection enable circuit determines that the first period of the reference clock signal is not changed when consecutive periods of the reference clock signal detected for a reference number of periods including the first period have a time difference from each other less than a reference time difference.

19. A display device comprising:

a display panel including a plurality of pixels;

a controller which generates a reference start signal and a reference clock signal;

a gate control circuit which outputs a gate start signal and a gate clock signal based on the reference start signal and the reference clock signal; and a gate driving circuit which provides gate signals to the plurality of pixels based on the gate start signal and the gate clock signal, wherein the gate control circuit comprises:

a protection enable circuit which detects a first period of the reference start signal, determines whether the first period of the reference start signal is changed, and generates a protection enable signal when the first period of the reference start signal is not changed; and an over-current protection circuit which generates an over-current occurrence signal by detecting an over-current of the gate start signal or the gate clock signal, and stops outputting the gate start signal and the gate clock signal based on the over-current occurrence signal and the protection enable signal.

20. The display device of claim 19, wherein the protection enable circuit determines that the first period of the reference start signal is not changed when consecutive periods of the reference start signal detected for a reference number of periods including the first period have a time difference from each other less than a reference time difference.

* * * * *